US005785173A

United States Patent [19]

Kim

[11] Patent Number: 5,785,173

[45] **Date of Patent: *Jul. 28, 1998**

[54] GOLF BAG WITH INSERTED SYMMETRICAL FULL LENGTH DIVIDER

[76] Inventor: Jin C. Kim, 4647 Clubview Dr., Westlake Village, Calif. 91362

[ * ] Notice: The portion of the term of this patent subsequent to Nov. 22, 2015, has been disclaimed.

[21] Appl. No.: 740,193

[22] Filed: Oct. 24, 1996

Related U.S. Application Data

[62] Division of Ser. No. 561,896, Nov. 22, 1995, Pat. No. 5,573,112.

[51] Int. Cl.[6] ..... A63B 35/00

[52] U.S. Cl. ..... 206/315.6; 206/315.3

[58] Field of Search ..... 206/315.3–315.6

[56] References Cited

U.S. PATENT DOCUMENTS

| | | | |
|---|---|---|---|
| 1,227,657 | 5/1917 | Pierce | 206/315.6 |
| 1,726,245 | 8/1929 | Shelton | 206/315.6 X |
| 1,788,478 | 1/1931 | Beaty et al. | 206/315.6 |
| 1,798,638 | 3/1931 | Stone et al. | 206/315.6 |
| 1,809,536 | 6/1931 | Tucker | 206/315.6 |
| 1,840,183 | 1/1932 | Blich | 206/315.6 |
| 2,023,792 | 12/1935 | Sampson | 206/315.6 X |
| 2,256,521 | 9/1941 | Kirkpatrick et al. | 206/315.3 |
| 2,294,084 | 8/1942 | Gihon, III et al. | 206/315.6 |
| 2,546,416 | 3/1951 | Alter et al. | 206/315.6 |
| 2,568,810 | 9/1951 | Kish, Jr. | 206/315.6 |
| 2,752,973 | 7/1956 | Stamp | 206/315.6 |
| 3,455,358 | 7/1969 | Kuzma | 206/315.6 |
| 3,729,036 | 4/1973 | McFadden | 206/315.6 |
| 4,172,484 | 10/1979 | Henning | 206/315.6 |
| 4,311,178 | 1/1982 | Kennedy | 206/315.6 |
| 4,691,823 | 9/1987 | Pape | 206/315.6 |
| 4,709,814 | 12/1987 | Antonious | 206/315.6 X |
| 4,911,292 | 3/1990 | Airey, Jr. | 206/315.4 X |
| 5,088,600 | 2/1992 | Kopp, Jr. | 206/315.6 X |
| 5,103,974 | 4/1992 | Antonious | 206/315.6 |
| 5,148,915 | 9/1992 | Ryan | 206/315.6 |
| 5,226,533 | 7/1993 | Antonious | 206/315.6 |
| 5,255,781 | 10/1993 | Dulyea, Sr. | 206/315.6 |
| 5,279,414 | 1/1994 | Brasher | 206/315.6 |
| 5,392,907 | 2/1995 | Blanchard et al. | 206/315.6 |
| 5,402,883 | 4/1995 | Shin | 206/315.6 X |
| 5,447,228 | 9/1995 | Hodgson, III | 206/315.6 X |
| 5,505,300 | 4/1996 | Joh | 206/315.6 |
| 5,573,112 | 11/1996 | Kim | 206/315.6 |

FOREIGN PATENT DOCUMENTS

| | | | |
|---|---|---|---|
| 216273 | 4/1955 | Australia . | |
| 428118 | 8/1911 | France | 206/315.5 |
| 1479 | of 1905 | United Kingdom . | |
| 8333 | of 1911 | United Kingdom | 206/315.5 |
| 349310 | 5/1931 | United Kingdom | 206/315.5 |
| 705115 | 3/1954 | United Kingdom | 206/315.5 |
| 2130102 | 5/1984 | United Kingdom | 206/315.6 |

OTHER PUBLICATIONS

"Golf Shop Operations", a Golf Digest Publication, Apr. 1990, Organizer on p. 124 sold by QS.

*Primary Examiner*—Sue A. Weaver
*Attorney, Agent, or Firm*—Curtis L. Harrington

[57] ABSTRACT

A golf bag of the present invention is of two-tube construction and has an outer tubular portion including a plurality of closable compartments. An inner tubular portion is provided having several embodiments of a golf club storage configuration which helps circumferentially distribute the load from the weight of the clubs about the internal periphery of the golf bag. The two-tube construction makes for a lighter, stronger, golf bag. The inner portion is made up of material sewn along the axial length of the inner portion and supported by a more rigid tubular exterior. The rigid tubular exterior is sewn to the soft cloth interior at one end to enhance the support and separation of the soft cloth interior, by providing a pulled anchoring of the soft cloth interior and its associated divider set. In one embodiment, the lower edge of the soft cloth interior is recessed one inch above the base of the rigid tubular exterior to provide adequate clearance for a central bumper pad carried in the base of the outer portion. In another embodiment, a plastic shield is provided which is sewn to the softer material and which may be provided with a rubber pad on the interior.

15 Claims, 13 Drawing Sheets

2
2
33
35
25
39
21
23
29
27
27
31

GOLF BAG WITH INSERTED SYMMETRICAL FULL LENGTH DIVIDER

This is a division, of U.S. patent application Ser. No. 08/561,896 filed Nov. 22, 1995, now U.S. Pat. No. 5,573,112.

FIELD OF THE INVENTION

The present invention relates to the field of sporting goods and equipment. More specifically, the present invention relates to embodiments of a golf bag and method of making which subdivides the central containment area of the golf bag into individual compartments which extend the full length of the golf bag, and which provides for a series of inner portions which may fit into a common outer portion.

BACKGROUND OF THE INVENTION

Conventional golf bags have a central containment volume in the form of an elongate cylindrical space. Typically the top or entrance of the golf bag may be reinforced with structures tending to divide only the entrance of the contained volume. While a subdivision of only the entrance of the golf bag helps to protect the club heads to a degree, the club shafts within the bag are free to bump and scratch each other. Further, the extent of the subdivision of the space at the entrance of the golf bag is typically limited to three or six openings. This number does not provide even separation of the clubs, which must be stored at least two clubs per opening. The opening subdivision structure also tends to have thick dividing members which restrict the entrance opening into the golf bag. Consequently a larger number of small subdivided spaces equates to a lesser overall opening space into the golf bag.

Many prior golf bags have attempted division of the bag space. For example, U.S. Pat. No. 5,392,907 to Blanchard et al, and entitled "Golf Club Separating Insert," discloses a series of hexagonal tubes forming a honeycomb pattern and encased in a golf bag. U.S. Pat. No. 4,172,484 to Luther T. Henning, and entitled "Golf Bag" discloses a further variation on the honeycomb pattern resulting in a hexagonal shaped golf bag.

U.S. Pat. No. 5,255,781 to Dulyea, Sr., entitled "Club organizer for Golf Bags", discloses a rigid continuous star shaped insert having a pinched configuration, and which uses connector inserts to hold the pinched configuration. U.S. Pat. No. 5,279,414 to Brasher, entitled "Golf Club Bag with Club Compartments", discloses a square golf bag having a center tube held in place by a series of angled compartments sized to carry the golf clubs with the handles in the up position. U.S. Pat. No. 5,226,533 to Antonious entitled "Golf Club Holder Insert for a Golf Bag" discloses a central finned tube inserted into a golf bag and wherein the central tube is higher than the rim of the golf bag.

These structures all disclose a rigid, heavy solution to the problem of sub-dividing the space within a golf bag. The method for joining the dividers only adds to the weight A pair of golf bags constructed earlier this century disclosed full length dividers. Great Britain patent No. GB-02-1911 disclosed a first embodiment having a transverse cross section divided into pie shaped chambers. A second embodiment disclosed a length of serpentine arranged material which formed a series of outwardly directed cup shaped (when view ed from the transverse direction) spaces used to support golf clubs individually. Bindings of leather close the bottoms of the formed pockets, and a central rod is used to hold the bag together.

In U.S. Pat. No. 1,798,638 to J. O. Stone and entitled "Golf Club Holder" a series of strips of material are sewn together with alternating width location seems such that when one set of opposite corners are pulled apart and secured to the inside of the golf bag, a 9×9 matrix is formed. A simpler model illustrating a seven unit matrix is also shown.

The problem with these designs include their weight, and in the case of Stone, the necessity to vertically anchor the expanded matrix along the length of the golf bag. Further, where the bottom of a series of individual spaces is closed or pinched, there may be a tendency to either wear the end of the golf club handle or to readily wear out the bottom and adjacent side edges of the individual chamber.

One bag which has been on the market has enabled a subdivision of the spaces of a golf bag from the entrance to the bottom. This bag has been originally commercially available by Cal Malibu, Inc. and sold under the trademark name CROSPETE®. The pattern involves looping side pockets, with the central space defined by the outer portion of the side pockets and also subdivided by an "X" divider. The upper two or three inches of the divided space is stiffened, giving way to soft material extending toward the bottom of the golf bag. Each space formed within the CROSPETE® bag is individual, extending all the way to the bottom of the bag. The CROSPETE® bag has 10 small storage spaces about the inner periphery of the bag in combination with four central storage spaces created by the "X" shaped divider which divides the remaining space. The advantages of providing individual spaces include the preservation of the golf clubs. The even dispersion of the spaces within the golf bag prevents the clubs from bunching at one side of the bag or the other. For golfers who carry their bags, the prevention of bunching can assist the golfer in carrying the bag.

Consequently it is important to prevent bunching of the clubs, and to stabilize them within the golf bag. It is preferable that they be stabilized about the periphery of the golf bag, but a given diameter golf bag has a limited peripheral space in which to store the clubs. What is needed is a bag which will enable separate storage spaces for clubs and will enable the distribution of the clubs in a pattern about the periphery of the bag space. The needed design should provide for some give and take between the individual storage spaces and should protect the grip ends as well as possible. The needed design should also allow for better control of the individual compartments, and avoid some of the irregular space which arises due to the "looping" of the material about the inner periphery of the golf bag. The area available for club storage should be subdivided to equalize areas available for club storage, yet not occupy the available area at the upper end of the bag.

Even more importantly, the design should accommodate the slamming of the golf club down into the bag with no appreciable wear of the dividers or the golf club grip end, and without a loud sound. The removal of the clubs should be accompanied by no binding or entangling of the golf club whatsoever.

The distribution should provide a compromise between the limited interior perimeter of a golf bag and the advantages of peripheral distribution of the clubs within the golf bag. The needed golf bag should be easy to construct. The construction of the needed golf bag should be amenable to a process which consistently produces a uniform high quality product.

SUMMARY OF THE INVENTION

The golf bag of the present invention is formed of an outer portion including a plurality of closable compartments as is typical in golf bags for the storage of golfing accessories. However, an inner portion is provided having a golf club storage configuration which helps circumferentially distribute the load from the weight of the clubs about the internal periphery of the golf bag. The storage area has various shapes which are incorporated to lend stability to the golf bag, protect the clubs, and make the golf bag easier to use and carry. The golf clubs may be carried in storage spaces formed about the periphery of the inner portion.

The inner portion is made up of material sewn along the axial length of the inner portion and supported by a more rigid tubular exterior. The rigid tubular exterior is sewn to the soft cloth interior at one end to enhance the support and separation of the soft cloth interior, by providing a pulled anchoring of the soft cloth interior and its associated divider set. In one embodiment, the lower edge of the soft cloth interior is recessed one inch above the base of the rigid tubular exterior to provide adequate clearance for a central bumper pad carried in the base of the outer portion. In another embodiment, a plastic shield is provided which is sewn to the softer material and which may be provided with a rubber pad on the interior.

Several embodiments, and their variants, are shown which operate to distribute the clubs spacing. By keeping the bulk of the clubs (or accessories) in a position where they cannot move around significantly and cannot shift across the middle axis of the bag, the fully loaded golf bag will be less apt to shift balance and will be more enabled to maintain a stable balance.

A first embodiment is formed by joining each of four lengths of material having a "V" cross section, from one point on an inner portion, to a square core, and then to another point on the inner portion. A second set of lengths of material join the midpoint of the "V" to the outer periphery of the inner portion. A second embodiment is had by subdividing the core in half.

In a third embodiment, the storage area has the shape of a six pointed star and provides six separate storage spaces between the six pointed star and an outer covering of the inner portion and six separate storage spaces in the tips of the six pointed star, and a storage space at the middle of the star. A fourth embodiment is formed by providing a divider which subdivides the core in half.

The fifth embodiment is achieved by using a hexagonal core and attaching angled sections to the core to form a six pointed star shape. A sixth embodiment is formed by subdividing the core of the third embodiment into halves.

A seventh embodiment is centered about a centrally located right angled cross divider and having individual curved sections of material added to the angular space between the right angled sections of the cross divider. These added sections have sufficient material and are sewn along a sufficient amount of the cross divider to form a relatively smaller diameter curve about midway to the center point of the cross divider. In an eighth embodiment, two additional individual compartment portions are added to each angular space between the right angled sections of the cross divider.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
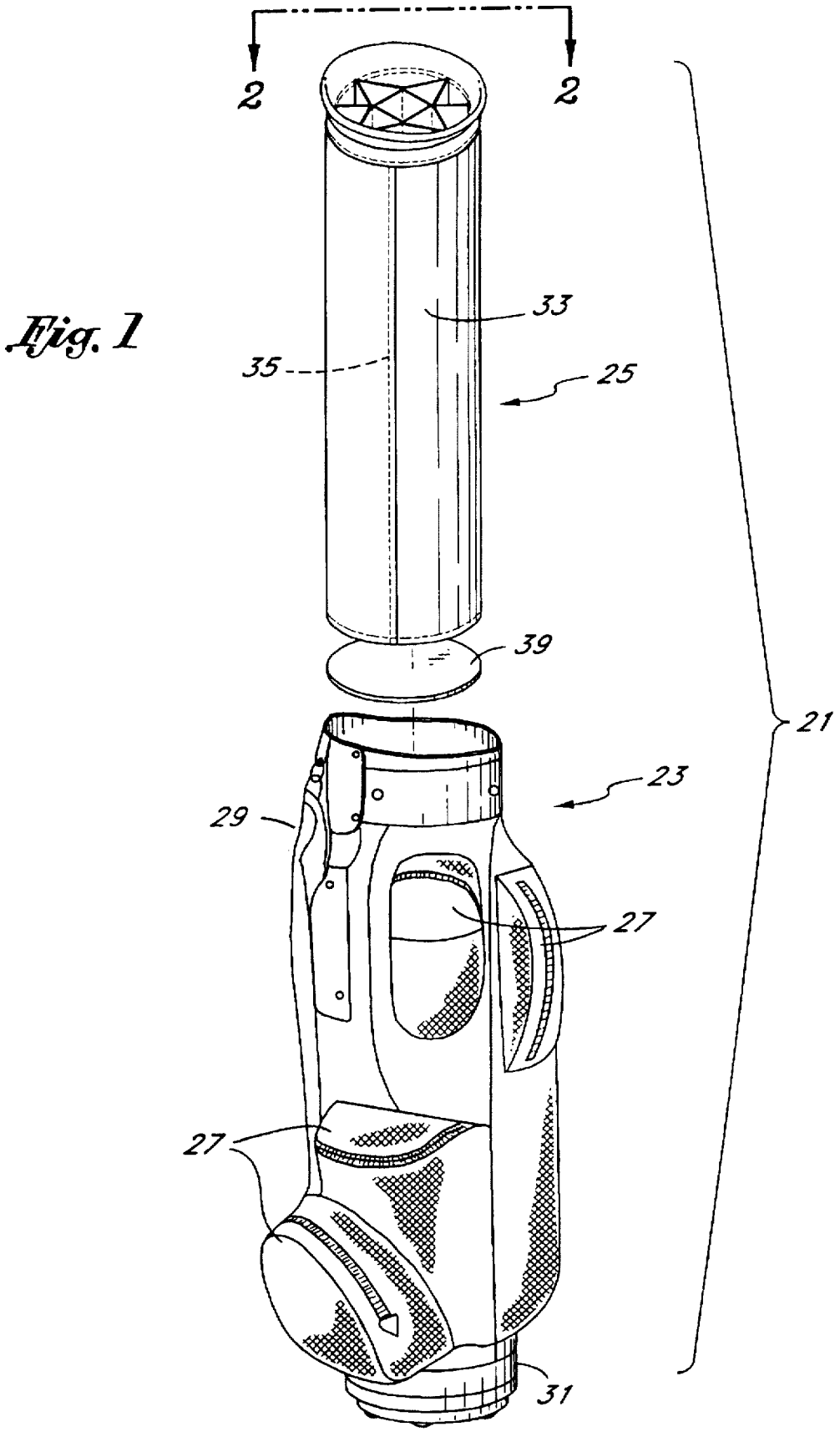
FIG. 1 is a perspective exploded view of a first embodiment of the golf bag of the present invention and illustrated with the inner portion above the main golf bag outer portion.

The description and operation of the invention will be best described with reference to FIG. 1. FIG. 1 is an exploded view of the golf bag 21 of the present invention which generally includes an outer portion 23 and an inner portion 25. The golf bag housing or outer portion 23 is a shell which may be formed in a conventional manner. The outer portion 23 has various compartments 27, as well as a carrying strap 29. The compartments 27 are typically closable as by zippers, snaps, and the like. The compartments 27 are typically used to carry extra towels, golf balls and tees. The outer portion 23 also may have a base 31 which may have structures to protect the bag 21 when it is placed on the ground.

The inner portion 25 includes an outer relatively rigid covering portion 33 which includes a vertical length of stitching 35 to form the covering portion 33 into a cylinder. Stitching 35 is shown in dashed line format, as is all stitching the drawings whether identified by number or not. Dashed lines indicate stitching, especially in the schematic drawings of FIGS. 9, 14, 19 and 22. The upper part of the inner portion 25 includes a thickened rim 37 and an upper shape which is suitable to interfit with the golf bag outer portion 23. The inner portion 25 is configured to fit within the outer portion 23 and may be held therein by a combination of glue or a strap from the outer portion 23 which secures the inner portion 25.

Also shown in FIG. 1 is a rubber pad 39 which is inserted into the outer portion 23 before the inner portion 25 is introduced. The rubber pad 39 protects the ends of the grips of the golf clubs and is arranged to cushion and keep quiet the golf clubs as they are placed in the golf bag.

Figure 2:
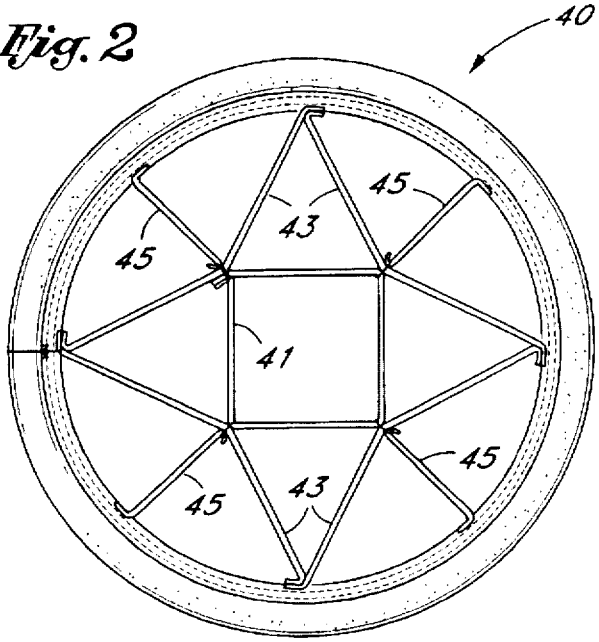
FIG. 2 is a downward view into an assembled golf bag which was shown in FIG. 1.

Referring to FIG. 2, a view taken along line 2—2 of FIG. 1 illustrates the overall configuration of the first embodiment of the golf bag 21. The inner portion 25 of the first embodiment has a central rectangular area and a series of lengths of materials forming dividers which extend virtually the full length of the inner portion 25. As will be shown, some clearance can be left to accommodate a foam or rubber pad which may be mounted in the base of the outer portion 23 of the golf bag 21. Limiting the extent to which the inner dividers which form divider set 40, extend in the downward direction, will cause an accommodation for the raised height rubber pad 39.

The dividers of FIG. 2 have a pattern which was based upon the sewn construction thereof. The central rectangle was made of one length of material 41. Each set of further dividers are made from a single length of material 43 which extends from a connection to the outer periphery, to a connection with the rectangular length of material 41, to a connection to the outer periphery. In addition, the center of each length of material 43 is also connected to the outer periphery of the divider structure by a single length of material 45. Note that some of the connection points have a series of end segments extending from the joints at angles which represent sharp deviations to the adjacent material. These end segments are used to assist in the sewing of the lengths of material 41, 43, and 45 to each other and to the periphery of the inner portion 25.

Since cloth material does not form a good bond based upon point contact, the end segments help to better hold the materials in a sewn fashion. Although not explicitly shown in FIG. 2, a thin length of material surrounds and is immediately connected to the lengths of material 41, 43, and 45 formed into the divider pattern shown in FIG. 2. The details of the construction will be shown beginning with FIG. 3.

Figure 3:
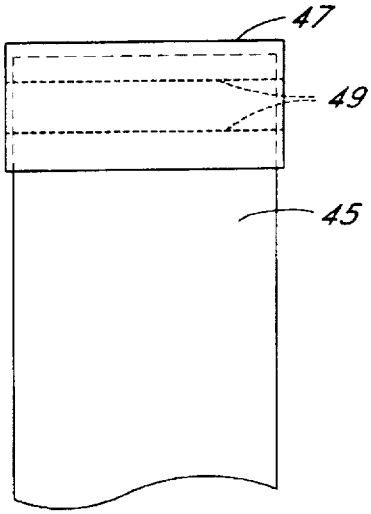
FIG. 3 is a typical length of material which is incorporated into the golf bag of the present invention and is shown being fitted at its upper end with a fold of reinforcing material.

FIG. 3 illustrates a length of material 43. Length of material 43 is shown, although either of the lengths of material 41 and 45 could be shown as an equivalent for purposes of the reinforcement material illustrated. The lengths of material 41, 43, and 45 differ only in their width.

A small piece of reinforcing material 47 is stitched to the top end of the length of material 43 using a pair of stitches 49. The reinforcing material 47 may be felt or corduroy. The purpose of the reinforcing material 47 is twofold. First, it provides some stiffening and reinforcing influence on the top of the divider group. Secondly, it can provide a finishing layer which will give an improved appearance.

Figure 4:
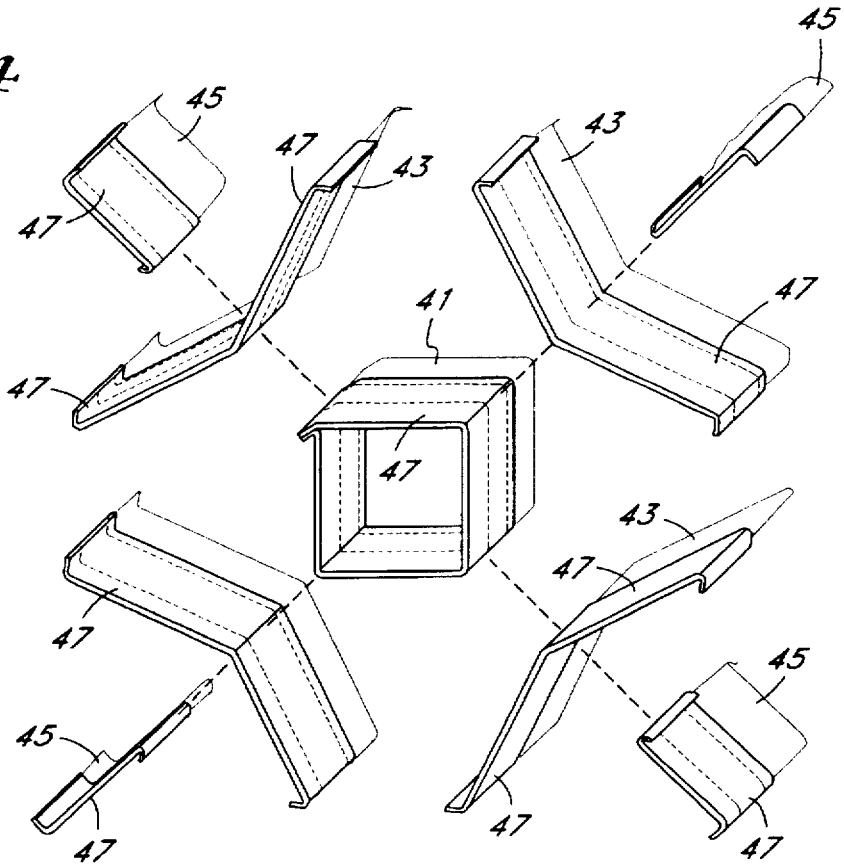
FIG. 4 illustrates a perspective end view of the segments which are joined together to form the divider system shown in FIGS. 1 and 2.

Referring to FIG. 4, an exploded perspective view of the end portions of the divider formed by the lengths of material 41, 43, and 45 is shown. Ideally, the lengths of material 43 and 45 will be sewn with one edge of the rectangular material 41 at a time. As the fourth set of the lengths of material 43 and 45 are joined to the rectangular length of material 41, the rectangular length of material 41 may be simultaneously closed.

Figure 5:
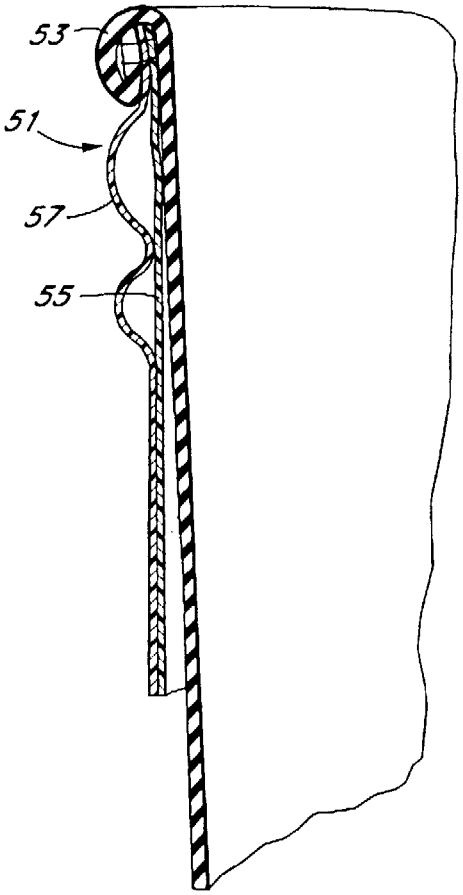
FIG. 5 illustrates the formation of the soft collar where a flexible plastic strip is sewn with a padded material and folded inwardly to form a collar.

Referring to FIG. 5, the formation of a collar 51 is shown. The collar 51 is made up of three layers of material. These materials have an area of expanse, although the term length will be used for simplicity. As can be seen in the Figures, the area of expanse must be sufficient to cover the inside and outside of the golf bag 21 structures with which the material is associated. A well-finished, rubber backed material 53 is sewn and arranged to be folded over the line of joinder of the three materials to form a soft, attractive rim. A second length of material 55 is made of relatively thin, relatively rigid material, such as polyvinyl chloride. This material will support being sewn to the divider structures previously shown in FIGS. 1–4.

Between the rubber backed material 53 and the inner second length of material 55 is a length of ring accommodating material 57.

As can be seen, rubber backed material 53 is oriented such that the rubberized side faces and is joined to ring accommodating material 57. This enables the rubber backed material 53 to be brought upward and around the seam where it is joined to materials 55 and 57 and down along side the inside of material 55 to expose the finished surface and to hide the rubber backing completely.

The length of ring accommodating material 57 has a gentle groove along its length which will accommodate a welded ring between the ring accommodating material 57 and the second length of material 55.

It is preferable for a thin length of covering material 61 to be incorporated into the divider structure at the same time in which the collar 51 is formed, and also while the divider assembly is formed. The upper edge of the thin length of covering material 61 is preferably captured between the second length of material 55 on the outside and the rubber backed material 53 as it extends downward along the inner surface of the collar 51. This sewing step could be facilitated by using a form or other structure to hold the layers together during sewing.

A pair of stitching 62 surrounds the second length of material 55 and may extend through a part of the thin length of covering material 61.

In some cases only a limited extent of the upper edge of the thin length of covering material 61 need be captured between the second length of material 55 and the rubber backed material 53, to facilitate this sewing procedure. Optionally, the reinforcing material 47 may be used along the upper length of the thin length of covering material 61 where further reinforcement and rigidity is needed. However, the reinforcing material 47 would preferably be somewhat thinner in order to prevent undue packing of the upper end of the divider set 40.

The thin length of covering material 61 may preferably be made slightly longer than the lengths of material 41, 43, and 45. At the upper end, this would enable more of it to be trapped in the layers forming the collar 51.

At the lower end of the divider set 40, this enables the end of the lengths of material 41, 43, and 45 to be recessed with respect to the thin length of covering material 61. This accomplishes several important functions. First, it enables the further sewing of the one inch length of covering material 61 which extends beyond the end of the lengths of material 41, 43, and 45 forming the divider structure. Second it provides a clearance for the rubber pad 39 which may be attached to the bottom of the outer portion 23. Third, the clearance will exceed the height of the rubber pad 39 and will thus provide some further clearance between the materials 41, 43, and 45 and the rubber pad 39 so that the ends of the golf club grips will not continually rub the bottom edge of the materials 41, 43 and 45 with their edges. This will contribute to a longer life for the divider while not subjecting the grips to rubbing by the divider material.

Figure 6:
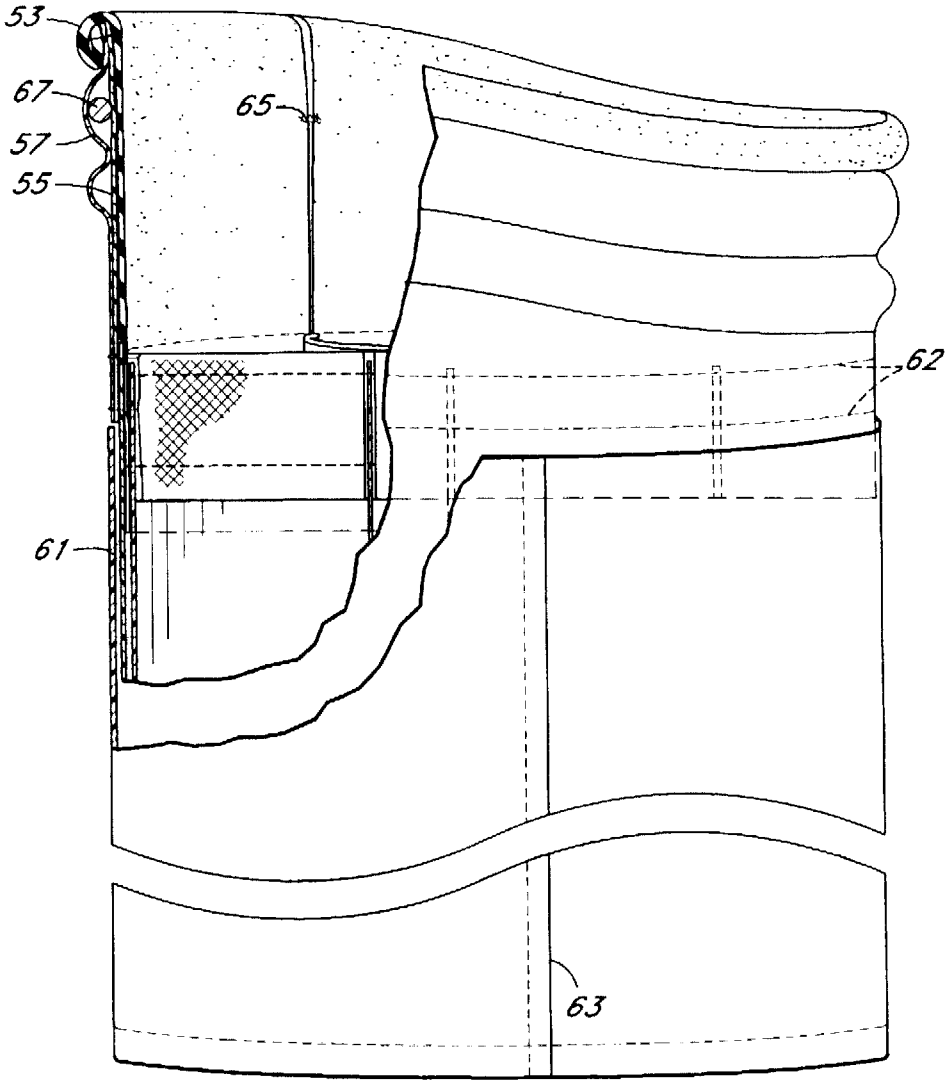
FIG. 6 illustrates the soft outer cylindrical layer being sewn to the structure shown in FIG. 4 along with the collar of FIG. 5 and including reinforcement sewing at each place where the divider structure contacts the collar.

Referring to FIG. 6, the length of material 61 is joined together by an elongate stitch 63, while the collar 51 is joined by a short joining stitch 65. Also shown is the ring 67 being brought into place to be moved over the length of material 61 and outside of the second length of material 55, but inside the softer length of ring accommodating material 57 of the collar 51. The ring 67 is typically about one fourth of an inch in diameter and may have welded ends rather than to be formed of a single length of material. The ring 67 rests against the second length of material 55 and within the groove in the softer length of ring accommodating material 57. The groove enables the ring 67 to be retained in place, especially once the inner portion 25 is brought to rest within the outer portion 23, to create clamping forces on the upper part of the inner portion 25.

Once the structure shown in FIG. 6 is formed, it has no rigid covering portion 33 as was shown in FIG. 1. The rigid covering portion 33 should preferably be made of a relatively thin layer of polyvinyl chloride. A length of such material is readily made into a cylinder by the use of an elongate stitch 35. The bulk of the lengths of material 41, 43, and 45 which form the divider structure beneath the collar 51 are then slipped into the covering portion 33.

Ideally the diameter of the covering portion 33 will somewhat match the diameter of the second length of material 55 so that neither one will "jam" into the other. The covering portion 33 is attached to the thin length of covering material 61 adjacent the bottom edge of the material 61. Thus, the covering portion 33 will be able to rotate about one fourth of an inch or less against the second length of material 55.

Figure 7:
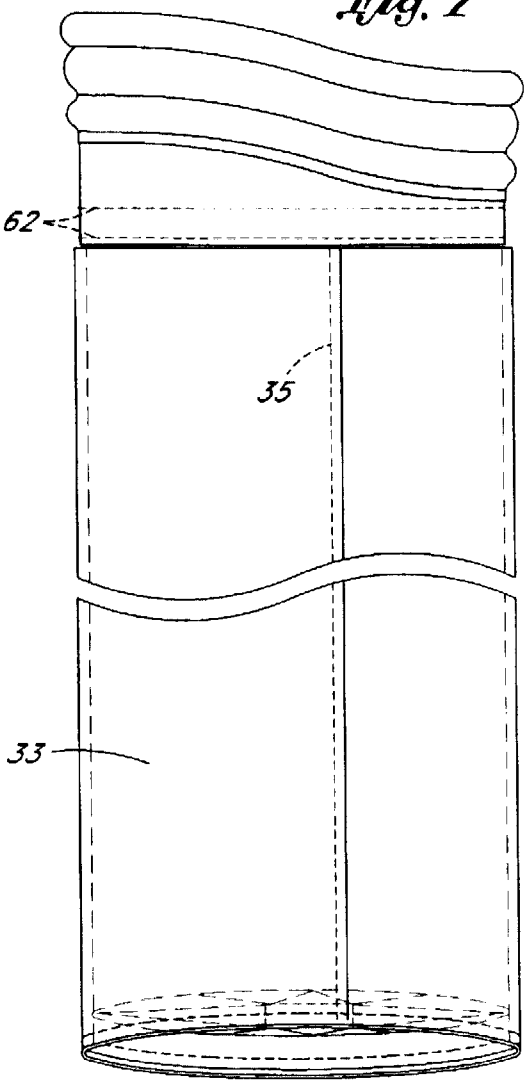
FIG. 7 illustrates the surrounding of the soft cylindrical layer with a plastic cylindrical member having an elongate seam, as well as the addition of a reinforcing ring underneath the collar, and how the base of the plastic cylindrical member is sewn to the lower edge of the soft cylindrical layer.

Also shown in FIG. 7, is a perspective view of the bottom of the inner portion 25 showing how the bottom of the divider set 40 is attached to the rigid covering portion 33. A single bottom stitch 68 surrounds the bottom periphery of the inner portion 25 joining the thin length of covering material 61 to the rigid covering portion 33. In this manner, the rigid covering portion 33 tends to anchor the thin length of covering material 61, which in turn stabilizes the lengths of material 41, 43, and 45, to stabilize the spacing and orientation of divider set 40.

The resulting structure leaves the only connection that the collar 51 will have with the rigid covering portion 33 to be through the thin length of covering material 61. The fact that the rigid covering portion 33 abuts the lower edge of the collar 51 will be sufficient to keep the structure of the divider set 40 in tact. Preferably, the vertical stitching 35 does not join the rigid covering portion 33 with the materials 41, 43, and 45 making up the divider structure.

Figure 8:
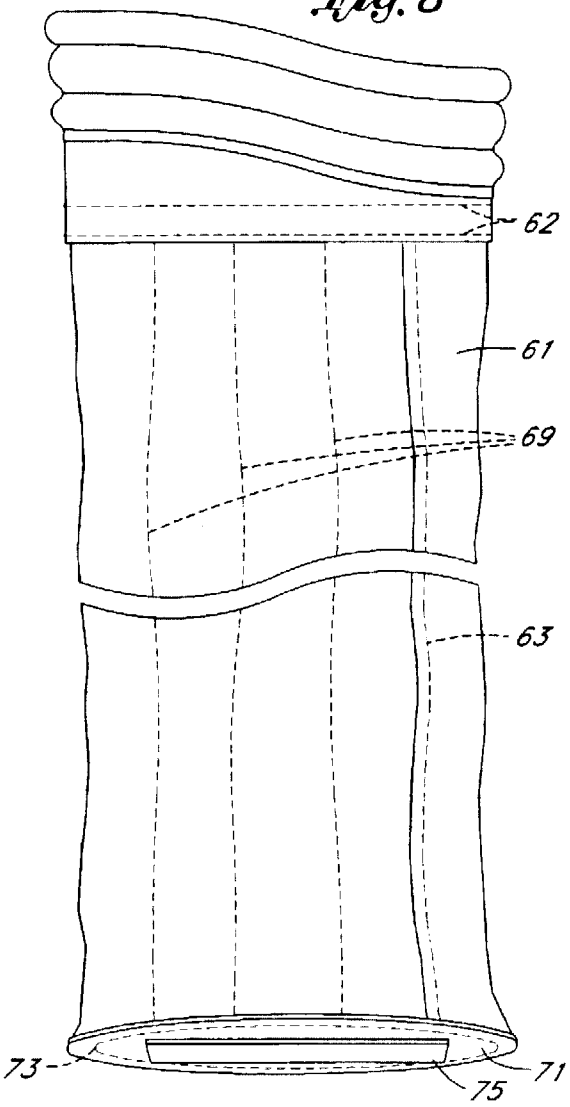
FIG. 8 is an alternative method of construction using a lower plastic insert and attachment structure.

FIG. 8 illustrates an alternative embodiment for the exterior of any of the inner portions 25 shown with respect to the present invention. In this embodiment, the rigid covering portion 33 is not added and the exterior of the divider set 40 will be formed by thin length of covering material 61. This view also fully illustrates vertical stitching 69 which joins the thin length of covering material 61 to the lengths of material 43 and 45. As can be seen, this connection will enable the inner materials 41, 43 and 45 to be held in their proper shape once the thin length of covering material 61 is pulled down and into place by the rigid covering portion 33 shown in FIG. 7.

However, for FIG. 8, a planar length of material 71 is joined to the thin length of covering material 61. The method of joining is by a circular stitch 73 which engages the lower edge of the thin length of covering material 61 as it is flared out parallel to the planar length of material 71.

The tension or downward anchoring necessary to keep the divider set 40 in an oriented position may be had through a patch of velcrostick material 75 which may be either one of an area of hook-like and felt like material to engage the other of hook-like or felt-like material which would be in place at the bottom of the outer portion 23. Both pieces of material 75 would preferably be fitted with adhesive, although it may be sewn to the planar length of material 71. As golf clubs are continued to be loaded into the completed golf bag 21, the material 71 will become even more attached and even further stabilize the divider set 40.

Figure 9:
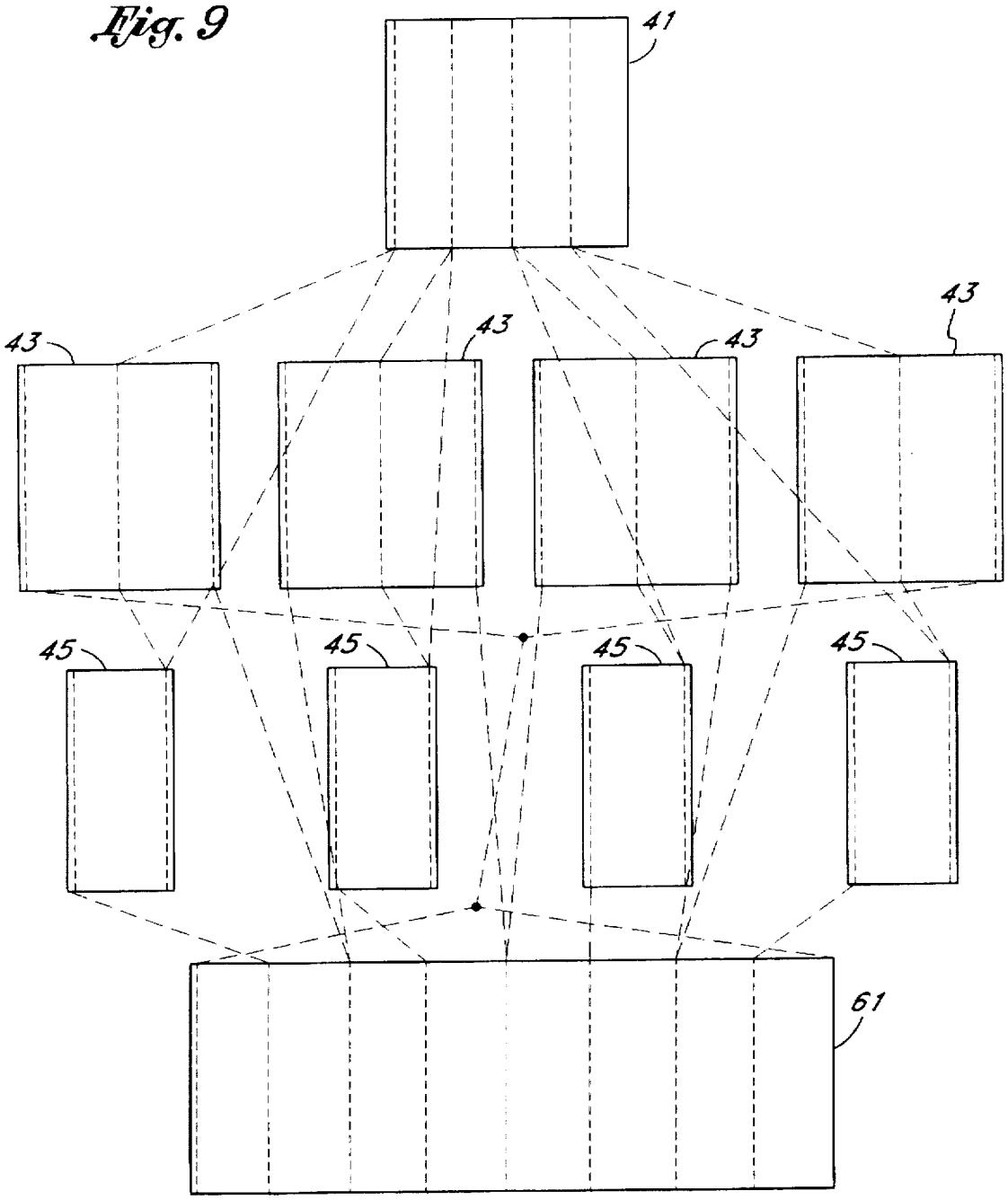
FIG. 9 is a schematic view of the lengths of material and their seams which are joined to make the embodiment of FIGS. 1, 2, and 4.

FIG. 9 illustrates a schematic overview of how the lengths of material 41, 43, and 45 are cut, sewn, partially or fully folded and joined. The dashed lines between each set illustrate the starting points for the vertical joinder of the relative two lengths of material. FIG. 9 is a guide as to how the material is cut and the relationships between the individual lengths of material 41, 43, and 45.

Figure 10:
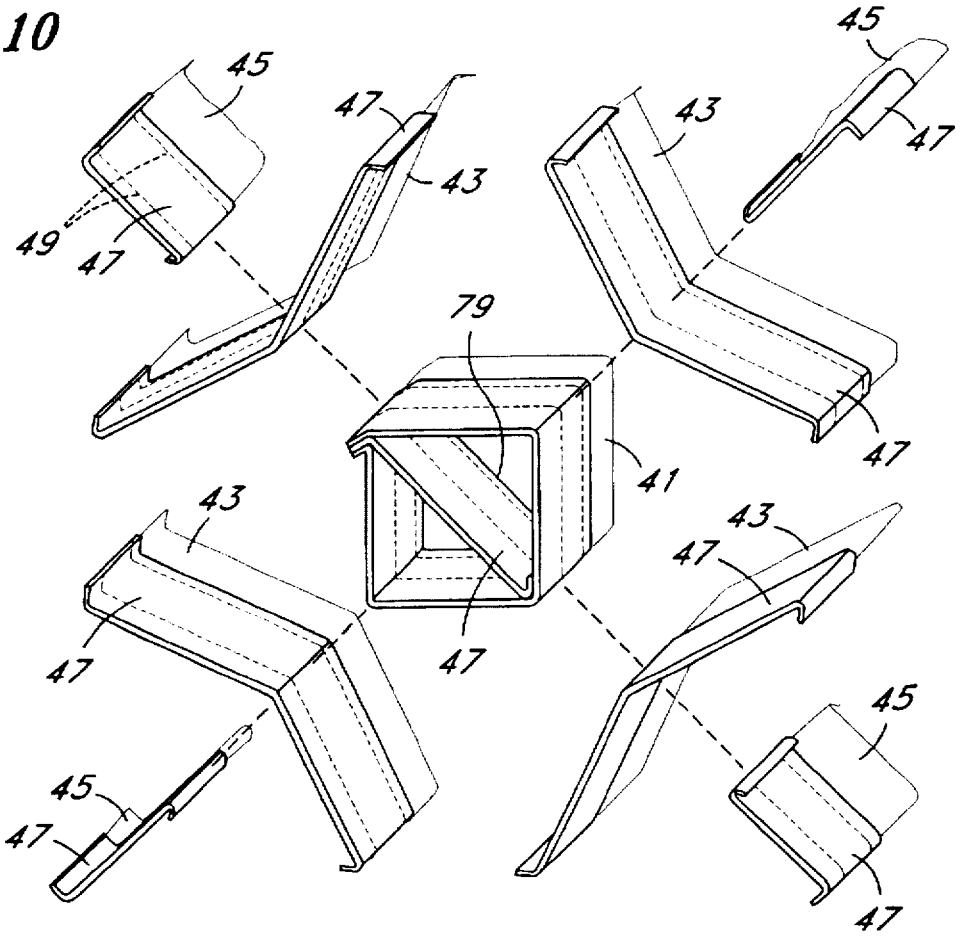
FIG. 10 is a view similar to FIG. 4, but with the addition to an additional length of material to form a central divider.
Figure 11:
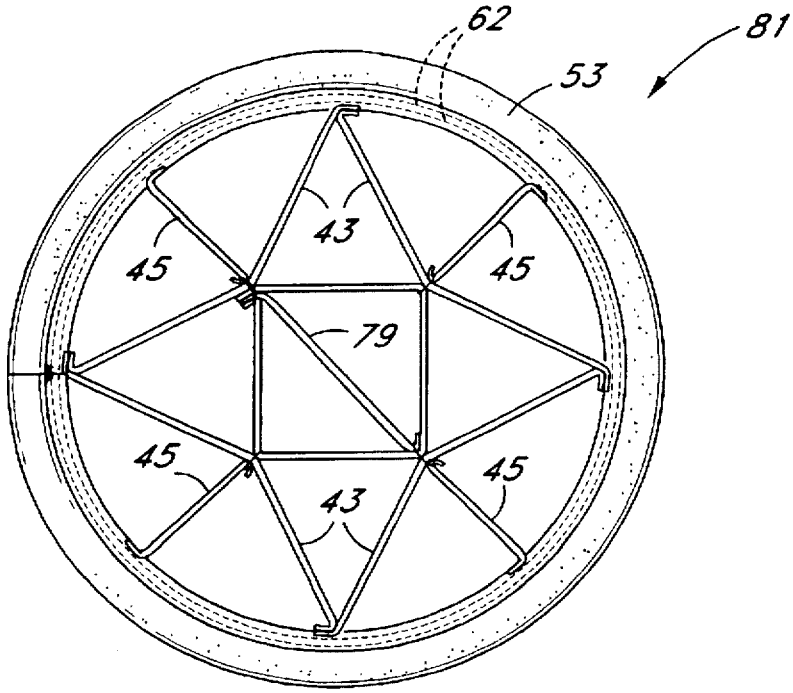
FIG. 11 illustrates a second embodiment formed by adding the additional length of material as shown in FIG. 10.

Referring to FIG. 10, a view similar to that shown in FIG. 4 is illustrated, but being partially completed. Also, there is the addition of an extra length of material which will form a center divider 79. Center divider 79 sub-divides the central space within the rectangular length of material 41 into two triangularly shaped spaces to form the second embodiment or divider set 81. Thus, without the center divider 79, the resulting golf bag 21 will have 13 individual compartments, while with the center divider 79 the golf bag will have 14 individual compartments. Note that for both the 13 and 14 compartment versions how evenly spaced and proportioned are the individual compartments.

Figure 12:
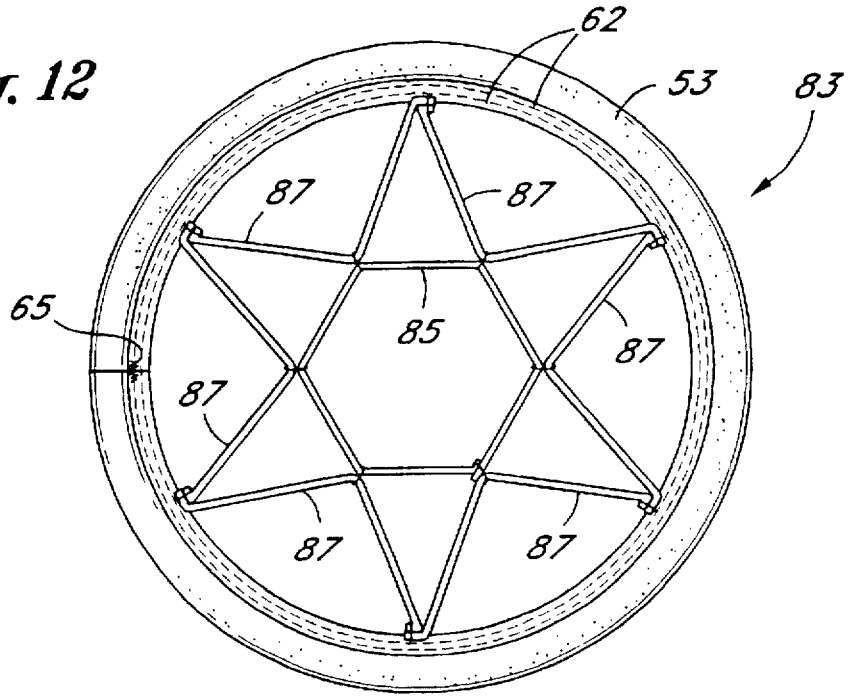
FIG. 12 illustrates a fifth embodiment of the golf bag of the present invention in the shape of a six pointed star within a circle.

Referring to FIG. 12, a third embodiment divider set 83 is made in the shape of a six pointed star shape structure, including its outer circle which is now known to be formed of the finished side of rubber backed material 53. The divider set 83, is made up of an inner hexagonal portion 85, and a series of outer angled portions 87, surrounding the inner hexagonal portion 85.

Each outer angled portion 87 extends from a point at the circular periphery of the divider set 83 to its midpoint where it is attached to an outside corner of the inner hexagonal portion 85 and then to another point at the circular periphery of the divider set 83. Both of the points of attachment for each outer angled portion 87 are shared with the other angled portions 87 such that each point of attachment provides attachment to two angled portions 87. The angled portions 87 again have some additional material to facilitate rugged sewn attachment.

Figure 13:
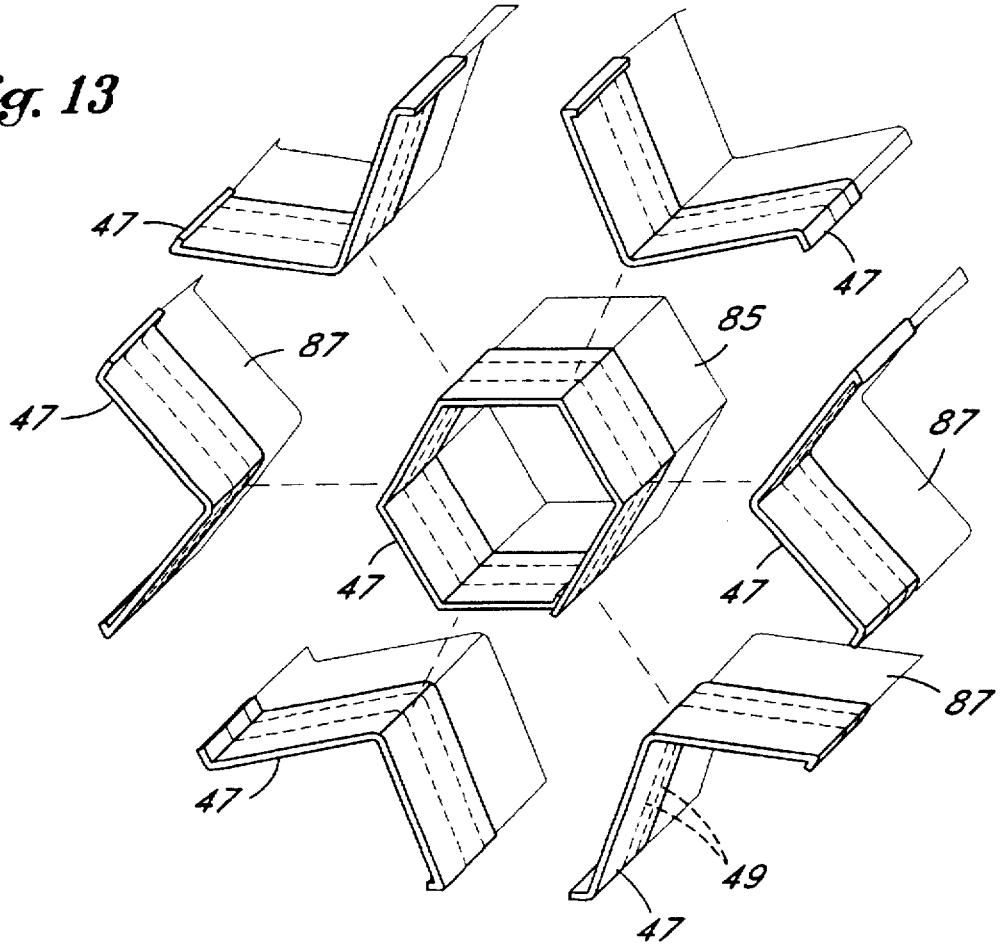
FIG. 13 illustrates a perspective end view of the end segments which are joined together to form the divider system shown in FIG. 12.

FIG. 13 illustrates a perspective end view of the end segments which are joined together to form the divider system which was shown in FIG. 12. Again, the inner hexagonal portion 85 and outer angled portions 87 will carry reinforcing material 47 at the top edge as was shown in FIG. 3. The thin length of covering material 61 used in the first two embodiments will be joined to the embodiment of FIG. 13 in an identical pattern, although it is not shown in FIG. 13. Since both the inner hexagonal portion 85 and the outer angled portions 87 will preferably be made of soft thin material, the material may initially assume a rather limp overall shape.

As an alternative to all embodiments, both the inner hexagonal portion 85 and outer angled portions 87 can be made by using semi-rigid materials and the like. Of course, where very thin materials will be used, the star shape at the top of the divider set 73 may give way to a more loose internal organization. However, as will be shown, where an outer layer such as thin length of covering material 61 is joined to the rigid covering portion 33 in a manner identical to that for the first and second embodiments, the six pointed star shape will be sufficiently maintained along the depth of the divider.

Figure 14:
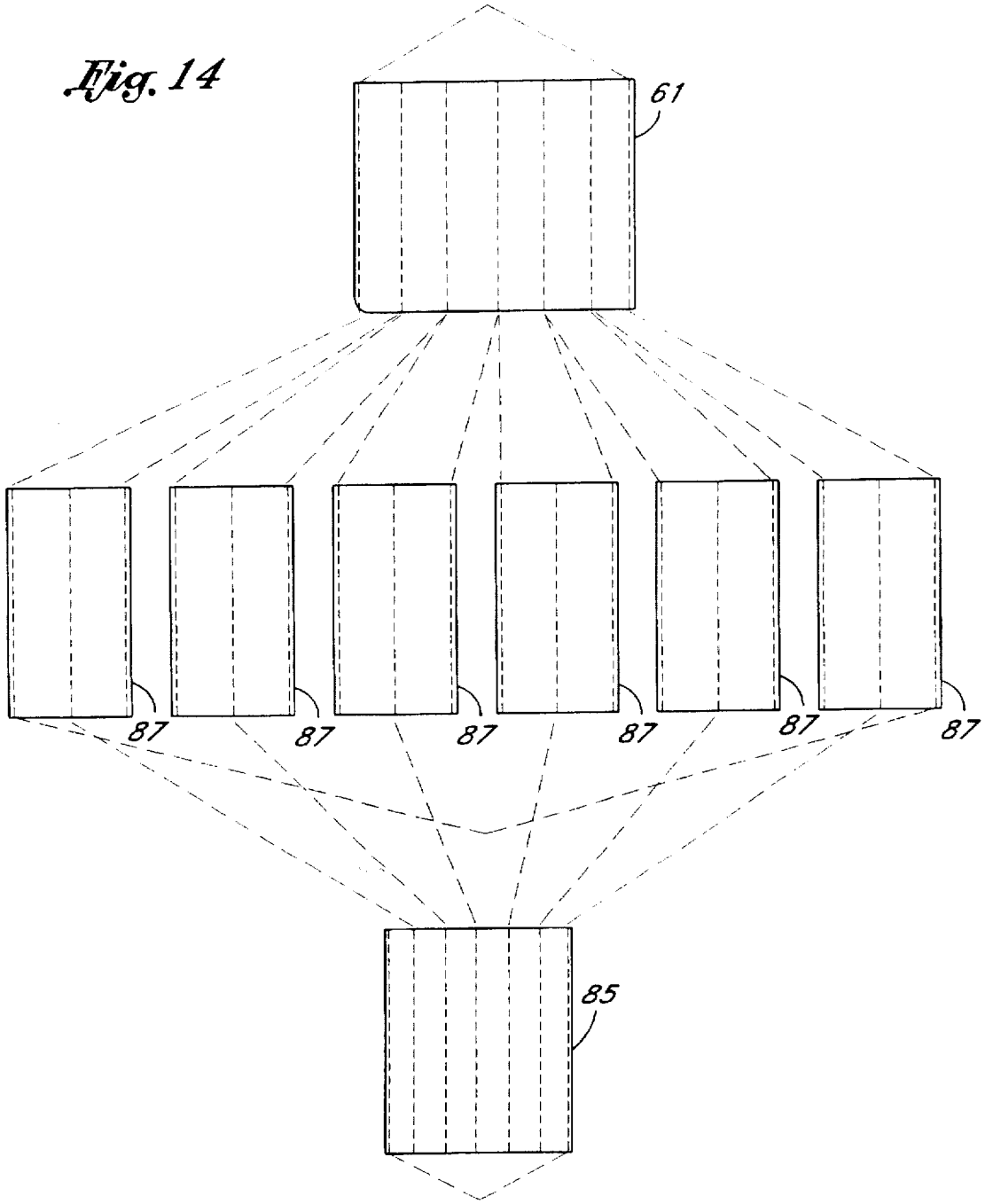
FIG. 14 is a schematic view of the lengths of material and their seams which are joined to make the embodiment of FIGS. 12 and 13.

FIG. 14 illustrates a schematic overview of how the inner hexagonal portion 85 and outer angled portion 87 are joined together with the thin length of covering material 61 to form the embodiment of FIGS. 12 and 13.

Figure 15:
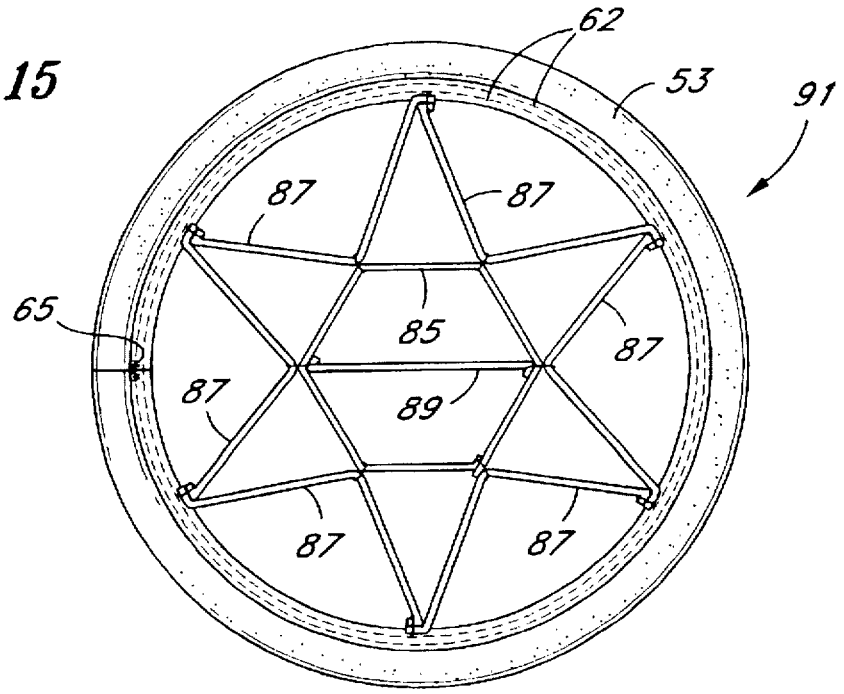
FIG. 15 illustrates a fourth embodiment formed by adding an additional length of material to subdivide the central space.

FIG. 15 illustrates a fourth embodiment formed by adding an additional length of material, or center divider 89 to form divider set 91. Without the center divider 89, the resulting divider set 83 defines 13 individual compartments. With the center divider 89, the divider set 91 defines 14 individual compartments.

Figure 16:
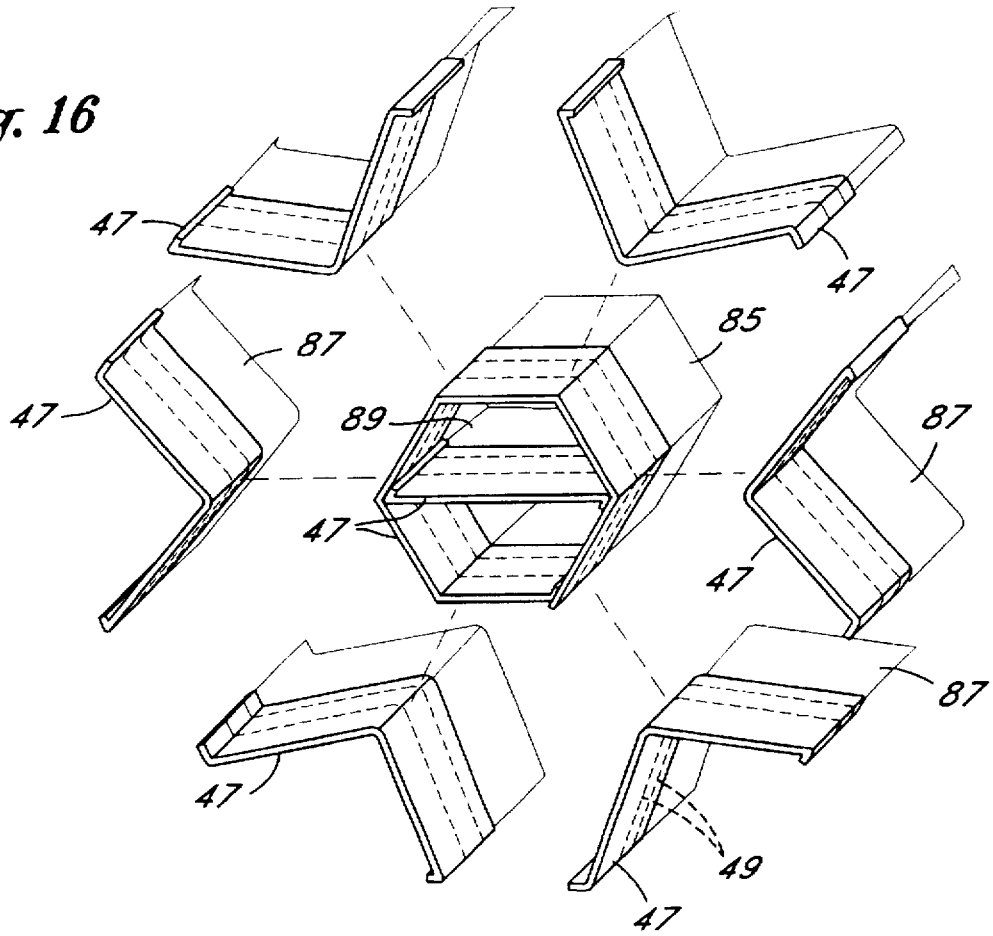
FIG. 16 illustrates a perspective end view of the end segments which are joined together to form the divider system shown in FIG. 15.

FIG. 16 illustrates the formation of divider set 91, and including the presence of the center divider 89. The thin length of covering material 61 used in the first two embodiments will be joined to the embodiment of FIG. 16 in an identical pattern. Although the pattern shown is represented by the shapes of the center divider 89, inner hexagonal portion 85 and outer angled portions 87, in their final form which are shown in exploded view apart from each other, the sewing operation will involve sequentially forming one joint or connection at a time.

Typically the connections relating to the center divider 89 will be formed such that one connection will be first formed with a corner of the inner hexagonal portion 85 to its associated outer angled portion 87, and the connection to the collar 51 and or thin length of covering material 61 will be made after the corners of the inner hexagonal portion 85 are all attached to their outer angled portions 87. The center divider 89 will preferably be added during the connection of the first outer angled portion 87 and then during the connection of the fourth outer angled portion 87. In this manner the center divider 89 is added as the inner hexagonal portion 85 is formed. An equivalent method would be to form the center divider 89 as the second and fifth corners are attached to the center divider 89. Another equivalent method would involve the formation of the center divider 89 as the third and sixth corners of the inner hexagonal portion 85 is formed.

Again shown in FIG. 16 is the presence of reinforcing material 47. It is also still possible to attach the thin length of covering material 61 while the inner hexagonal portion 85, center divider 89 and the outer angled portions 87 are being attached.

Figure 17:
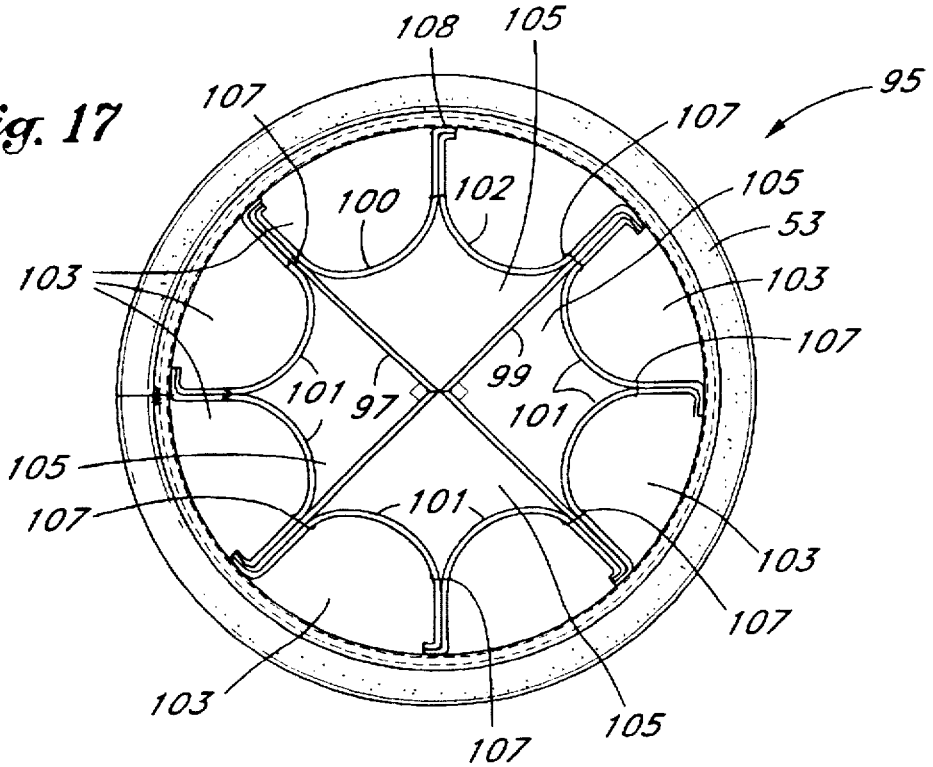
FIG. 17 illustrates a seventh embodiment of the golf bag of the present invention in the shape of a right angled cross providing space for curved outwardly disposed pockets.

FIG. 17 illustrates a seventh embodiment of the golf bag of the present invention in the shape of a right angled cross providing space for curved outwardly disposed pockets. This divider set 95 includes a first main divider 97 and a second main divider 99. A number of individual compartment portions 101 are distributed between the ends of the first and second main dividers 97 and 99. Two of the individual compartment portions are numbered 100 and 102 to show a starting point and a finishing point. Since an equal number of individual compartment portions 101, 100 and 102 are distributed between the ends of the first and second main dividers 97 and 99, right angles are formed at the center of the divider set 95.

Figure 18:
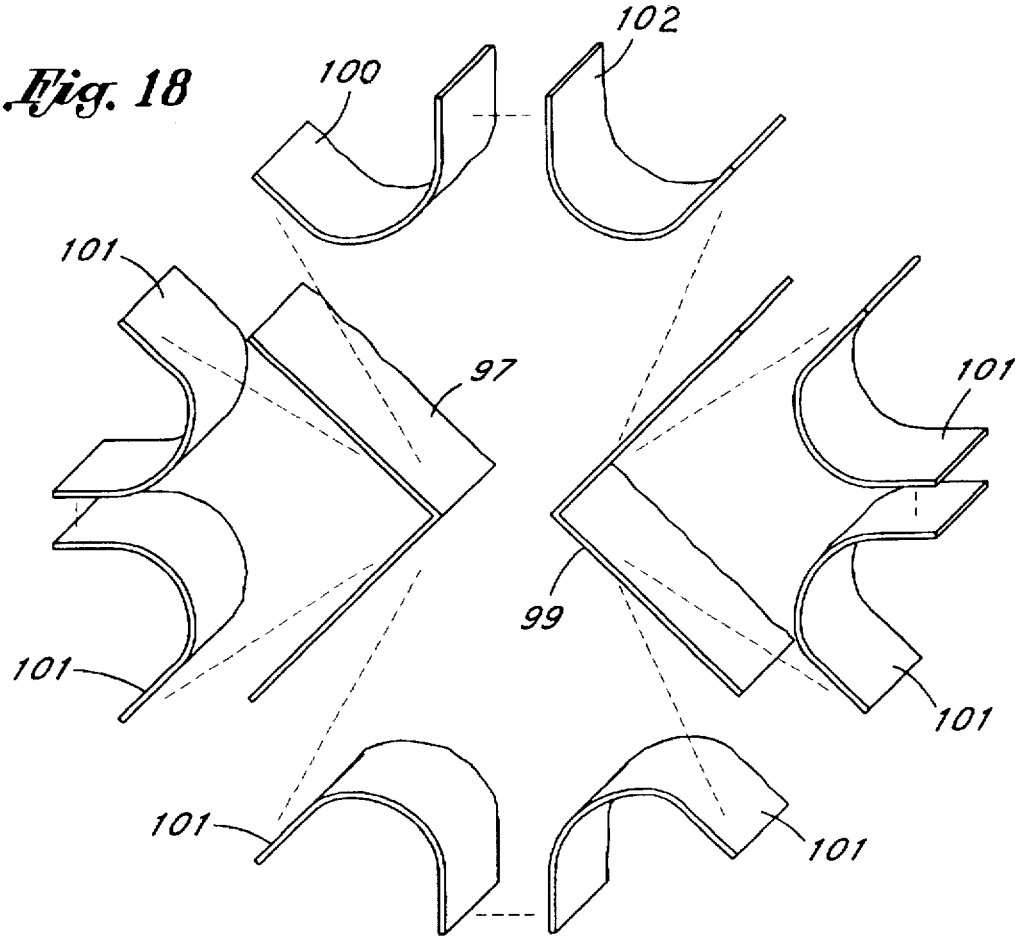
FIG. 18 illustrates a perspective end view of the end segments in a position to be joined together to form the divider system shown in FIG. 17.

As can be seen in FIG. 18, the first and second main dividers 97 and 99 are joined at their respective midlines to each form a right angle with itself and also a right angle with respect to the space between the first and second main dividers 97 and 99, respectively. The individual compartment portions 101, 100, and 102 are not merely left to assume a freeform shape, but are joined to each other and to a main divider 97 or 99. The joinder of the individual compartment portions 101, 100, and 102, as well as the specification of the width of the individual compartment portion widths that will be used for a given diameter of the divider set 95, will determine the relative distribution of the area available for storage.

Each compartment portion 101, 100, 102 is circumferentially outwardly disposed and defines an outer compartment space 103 in its outwardly disposed area, and defines an inner compartment space 105 between directly adjacent compartment portions 101, 100, and 102 and one or both of the first and second main dividers 97 and 99. Thus, adjacent compartment spaces 103 and inner compartment spaces 105 have areas of approximately similar magnitude.

Further, the adjacent compartment portions 101, 100, and 102 to be joined need only be joined with sets of stitching 107 which are shown as controlling the shape and curvature of the resulting compartment space 105 and the space within the outer compartment spaces 103. At the junctions of the individual compartment portions 101, 100, and 102 are small end portions 108, similar to the end portions shown in earlier Figures, which helps to secure the divider set 95 to the collar 51, as was shown for the first embodiment.

Referring to FIG. 18, a perspective end view of the end segments during formation to manufacture divider set 95 are shown. They are in a position to be joined together to form the divider system 95 shown in FIG. 17. The reinforcing material 47 has been eliminated from FIG. 20 for clarity of illustration. Normally, all embodiments of the inner portion 25 will be expected to have such portions of reinforcing material 47 at the ends unless the material of construction is otherwise thick or durable enough to withstand an accidental poke from the end of a golf club.

Alternately, the top portions of the material 41, 43, 45, 85, 87, and 89 can be folded over on itself and sewn with stitches 49 to provide a reinforcing thickness. An insert can be incorporated where desired, to further stiffen the upper edges for any of the embodiments of the invention.

The process for constructing the inner portion 25 of FIGS. 17 and 18 may be best accomplished by first joining the first and second main dividers 97 and 99 at their center points. Next, pairs of individual compartment portions 101, 100, and 102 may be sewn together, remembering to leave small end portions 108 to enable the individual compartment portions 101, 100, and 102 to be better secured to the inside of the collar 51. Next, pairs of the formed sets of compartment portions 101, 100, and 102 are joined to both sides of one of the projections of one of the first and second main dividers 97 and 99.

The first operation of joining pairs of individual compartment portions 101, 100, and 102 involve four steps. The second operation of joining pairs to the first and second main dividers 97 and 99 also involves four steps. Both steps involve sewing the applicable materials all the way along their length.

After these steps have been accomplished, all that is left is to join the resulting structure to the collar 51 while adding on the thin length of covering material 61.

Figure 19:
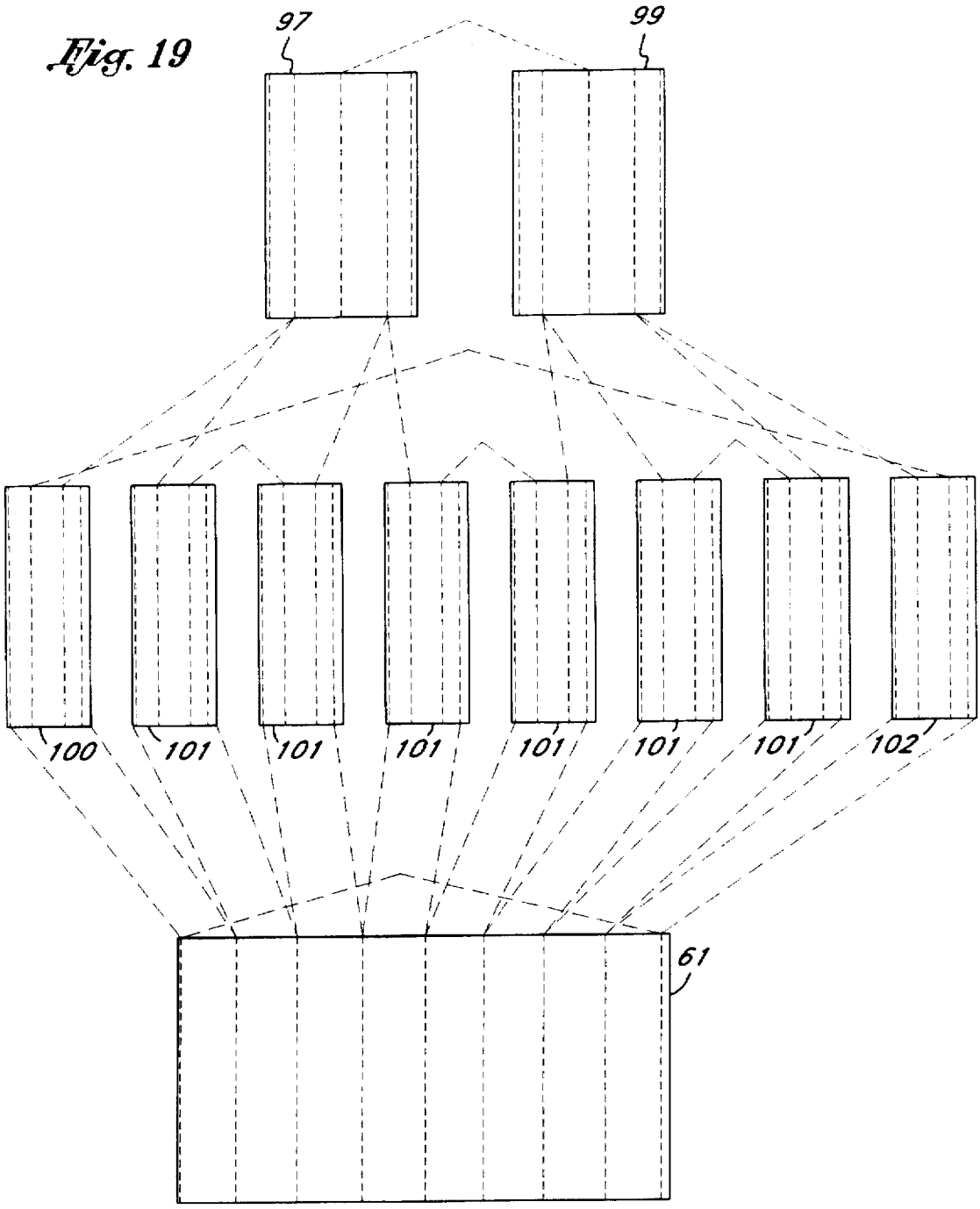
FIG. 19 is a schematic view of the lengths of material and their seams which are joined to make the embodiment of FIGS. 17 and 18.

FIG. 19 is a schematic view of the lengths of material and their seams which are joined to make the embodiment of FIGS. 17 and 18. This embodiment involves the use of several pieces, but the fact that the individual compartment portions 101, 100, and 102 are exactly alike saves time and improves the accuracy and quality of the product formed.

Figure 20:
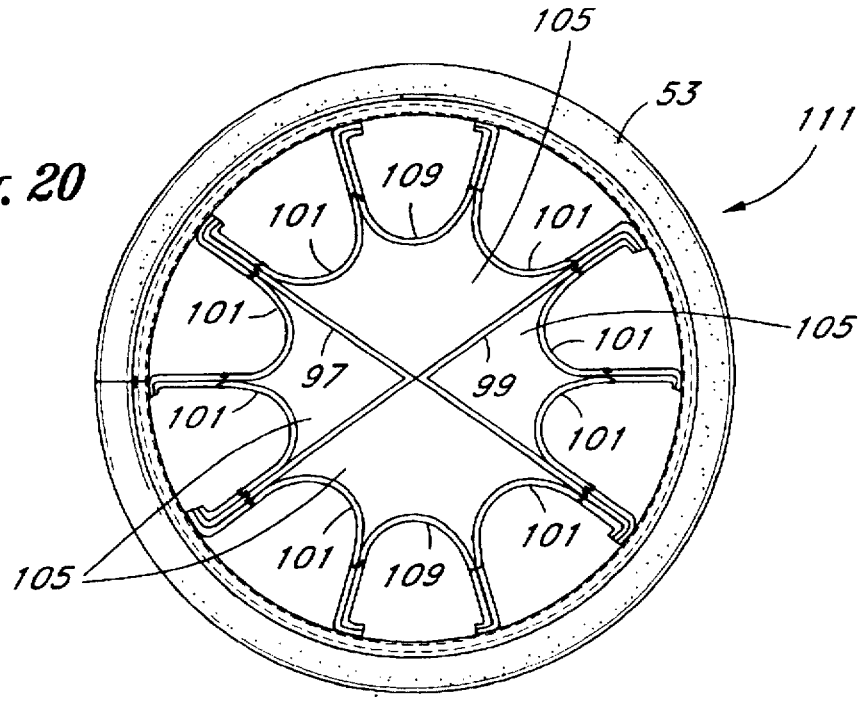
FIG. 20 is a view similar to that of FIGS. 17–19, but with the addition of two additional lengths of material to form an additional peripheral divider.

FIG. 20 is a view similar to that of FIGS. 17–19, but with the addition of two additional lengths of material to form a pair of additional compartment portions 109. Since the additional compartment portions 109 cause the resulting total number of compartment portions 101, 100, and 102 and 109 to be unevenly divided about the periphery of the resulting divider set 111 of the eighth embodiment, the first and second main dividers 97 and 99 will not meet at right angles.

Where divider set 95 contained 12 individual compartments, including outer compartment spaces 103 and inner compartment spaces 105, the divider set 109 contains 14 such individual compartments. Since divider set 109 will probably exist within the same overall outside diameter as the divider set 95, the compartments are proportionately smaller. A set of four inner compartment spaces 105 includes two which are larger and two which are smaller. A set of ten outer compartment portions 101, and 109 are presumably of equal size thus causing the uneven division of space between the pairs of inner compartment spaces 111. Alternatively, the angles of the first and second main dividers 97 and 99 could remain at the right angled relationship of FIG. 18 while the sizes of the individual outer compartment spaces formed by portions 101 and 109 could be enabled to vary.

Figure 21:
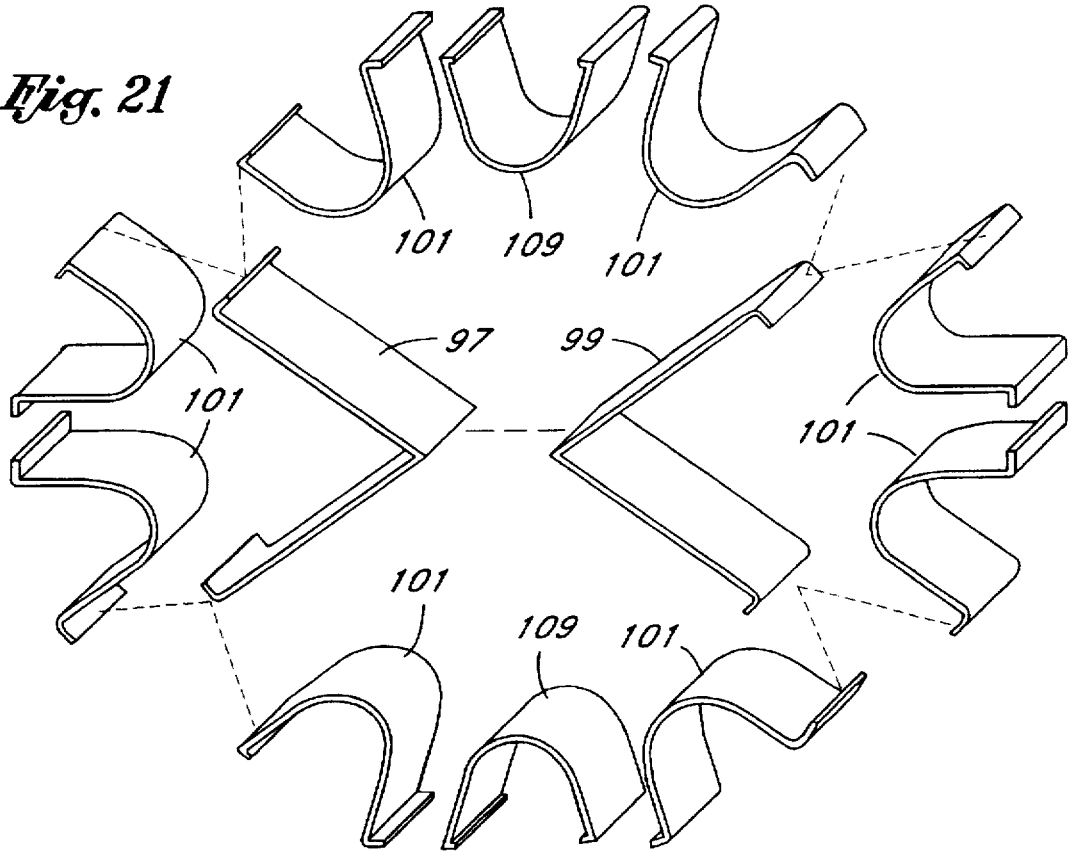
FIG. 21 illustrates a perspective end view of the end segments in a position to be joined together to form the divider system shown in FIG. 20.

FIG. 21 illustrates a perspective end view of the first and second main dividers and the adjacent compartment portions 101 and 109 in a position to be joined together to form the divider system shown in FIG. 20. Again, the reinforcing material 47 is not shown, only for illustrative convenience and clarity. It is understood that the widths of the adjacent compartment portions 101 and 109 may be altered to change the overall function of the configuration shown in FIG. 20. The widths of the compartment portions 101 and 109 and the location of the stitching 107 could be adjusted to give any configurational mix to the divider set 101.

Figure 22:
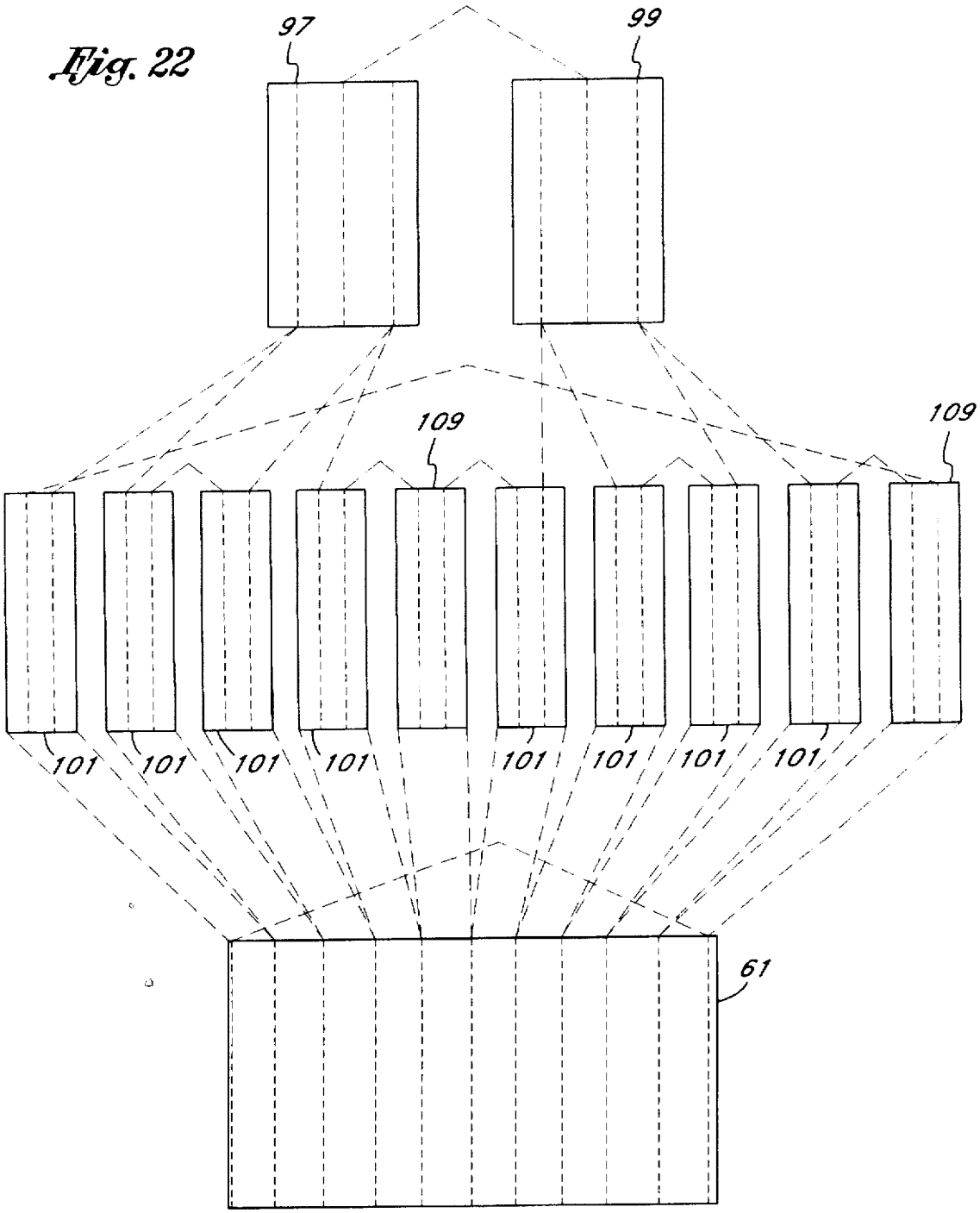
FIG. 22 is a schematic view of the lengths of material and their seams which are joined to make the embodiment of FIGS. 20 and 21.

FIG. 22 is a schematic view of the individual lengths of material, including individual compartment portions 101, 100, and 102, 109 and first and second main dividers 97 and 99 used to form divider set 111.

As can be seen, each of the divider sets 40, 71, 73, 81, 95 and 111 can fit into a common outer portion 23. Thus, the divider sets 40, 71, 73, 81, 95 and 109 can be used with outer portions 23 of various configurations, colors and types to enable further customization of the golf bag 21 without having to commit to a complete golf bag 21 configuration.

While the present invention has been described in terms of a golf bag, and in terms of several embodiments of an interior portions to be inserted into an outer portion of a golf bag, as well as the method of construction of the inner portions, one skilled in the art will realize that the structure and techniques of the present invention can be applied to many appliances. The present invention may be applied in any situation where compartments are to be created which are to circumferentially balance the load resulting from placement of objects in the compartments.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A golf bag divider assembly comprising:

an internal divider having a plurality planar portions each having an upper and a lower edge and including at least a pair of outer edges;

a length of covering material having a first end having a first edge and a second end having a second edge which extends below said lower edge of said internal divider providing a lower width beyond the lower edge of said internal divider, said length of covering material surrounding said internal divider and supporting said at least a pair of outer edges of said internal divider;

a rigid covering portion surrounding said length of covering material and having a lower width adjacent the lower width of said length of covering material and attached to said length of covering material adjacent said lower width of said length of covering material; and a collar attached to said first end of said length of covering material.

2. The golf bag divider assembly as recited in claim 1 wherein said internal divider further comprises:

a central divider having at least three planar portions each planar portion oriented adjacent another planar portion and forming a cylinder having a vertical axis, corners, and wherein said at least a pair of outer edges have at least three outwardly disposed outer edges; and a main divider section associated with each corner of each of said planar portion of said central divider and folded about a middle edge, and having a first outer edge, a second outer edge attached to said length of covering material, each divider section's middle edge joined to a different corner of said central divider.

3. A golf bag divider assembly as recited in claim 2 and further comprising a side divider section associated with each main divider section, each side divider section having a first edge joined said middle edge of said main divider section and a second edge attached to said length of covering material.

4. The golf bag divider assembly as recited in claim 2 and further comprising a center divider having a first and a second end both attached along said central divider, said center divider spanning a space created by said central divider.

5. The golf bag divider assembly as recited in claim 1 wherein said rigid covering portion surrounding said length of covering material has an upper edge and wherein said collar has a lower edge abutting said upper edge of said rigid covering portion.

6. A golf bag, including the golf bag divider assembly as recited in claim 1 wherein said assembly further comprises a golf bag outer portion having an upper opening into a cylindrical space into which said golf bag divider assembly is insertably fixed.

7. The golf bag divider assembly as recited in claim 1 wherein said collar further comprises:

a first length of material having a finished surface; and a second length of material attached to said to said first length of material to provide strength and structure to the upper end of said divider assembly.

8. The golf bag divider assembly as recited in claim 7 wherein said second length of material and said first length of material each have an upper edge, and said first length of material is attached circumferentially outwardly of said second length of material and folded up and within said second length of material to cover the upper edges of said first and said second lengths of material.

9. The golf bag divider assembly as recited in claim 7 wherein said collar further comprises:

a third length of material attached to and surrounding said second length of material and defining a ring groove; and a metal ring located between said second and said third length of material and lying within said ring groove.

10. The golf bag divider assembly as recited in claim 1 wherein said assembly further comprises:

a planar length of material attached to a lower edge of said length of covering material; and an attachment structure connected to said planar length of material and disposed oppositely with respect to said length of covering material.

11. The golf bag divider assembly as recited in claim 1 wherein said upper edge of said internal divider have upper edges and upper portions reinforced with reinforcing material attached to said upper portions.

12. The golf bag divider assembly as recited in claim 1 wherein said internal divider further comprises:

an elongate inner hexagonal portion having a transverse hexagonal shape;

a plurality of elongate outer angled portions and folded about a middle edge, and having a first and a second outer edge attached to said length of covering material, each outer angled portion's middle edge joined to a different corner of said elongate inner hexagonal portion.

13. A golf bag, including the golf bag divider assembly as recited in claim 12 wherein said assembly further comprises a golf bag outer portion having an upper opening into a cylindrical space into which said golf bag divider assembly is insertably fixed.

14. The golf bag divider assembly as recited in claim 12 and further comprising a center divider having a first and a second end attached to and along a length of said elongate inner hexagonal portion and spanning said inner hexagonal portion.

15. The golf bag divider assembly as recited in claim 1 wherein said internal divider further comprises:

an elongate first main divider having a central fold angle to form a pair of planar divider portions having outer edges;

an elongate second main divider having a central fold angle to form a pair of planar divider portions having outer edges, the central fold angles of said first and said second main dividers attached substantially along their length, and having their outer edges attached to said length of covering material;

a plurality of elongate individual compartment portions having a first and a second side end both attached to said length of covering material and wherein said collar attached to said first end of said length of covering material.

* * * * *